US005550790A

United States Patent [19]

Velamoor et al.

[11] Patent Number: 5,550,790

[45] Date of Patent: Aug. 27, 1996

[54] ACOUSTIC TRANSDUCER FOR LEVEL MEASUREMENT IN CORROSIVE CHEMICAL ENVIRONMENTS

[75] Inventors: Sesh Velamoor, Mercer Island; Kai P. Mesterton, Monroe, both of Wash.

[73] Assignee: Kistler-Morse Corporation, Redmond, Wash.

[21] Appl. No.: 386,744

[22] Filed: Feb. 10, 1995

[51] Int. Cl.[6] ..... H04R 17/00

[52] U.S. Cl. ..... 367/140; 367/908; 310/336; 310/340

[58] Field of Search ..... 367/908, 140, 367/157; 310/334, 336, 340, 344

[56] References Cited

U.S. PATENT DOCUMENTS

| | | | |
|---|---|---|---|
| 4,072,056 | 2/1978 | Lee . | |
| 4,183,007 | 1/1980 | Baird | 367/119 |
| 5,121,628 | 6/1992 | Merkl et al. | 367/908 |
| 5,295,120 | 3/1994 | McShane | 367/188 |
| 5,315,563 | 5/1994 | Lichtenfels, II et al. | 367/99 |
| 5,327,041 | 7/1994 | Culp | 310/328 |
| 5,363,341 | 11/1994 | Schwald et al. | 367/140 |

*Primary Examiner*—J. Woodrow Eldred
*Attorney, Agent, or Firm*—Seed and Berry LLP

[57] ABSTRACT

An ultrasound transducer includes a resonant driving assembly having an ultrasound radiating surface covered with a propagation disc of impedance matching material. The resonant driving assembly and propagation disc are housed in a polymeric or stainless steel enclosure. All exposed surfaces of the enclosure, resonant driving assembly, and disc are covered with a coating of polyparaxylylene to make the transducer substantially impervious to industrial chemicals.

11 Claims, 1 Drawing Sheet

ACOUSTIC TRANSDUCER FOR LEVEL MEASUREMENT IN CORROSIVE CHEMICAL ENVIRONMENTS

TECHNICAL FIELD

This invention relates to acoustic transducers for measuring the levels of industrial chemicals in storage vessels. More specifically, the invention is concerned with an acoustic transducer suitable for prolonged exposure to a wide variety of corrosive chemicals in industrial applications.

BACKGROUND OF THE INVENTION

Manufacturers, transporters, and users of industrial chemicals generally need to track the amount of inventory present in their storage vessels, or to detect varying material levels in process-control systems. A number of instruments designed to be mounted inside the vessels are available for this purpose, including capacitance probes, pressure transducers, and air-ranging ultrasonic transducers. However, the design and shape of the vessel may make application of systems that make contact with the liquid in the vessel impractical, thus making a non-contact system such as the ultrasonic transducer the most cost-effective and preferred approach.

Liquid-ranging ultrasonic transducers designed to mount on the outside of the vessel are available. These units are designed to mount under the bottom of the vessel in such a way that their radiating surface imparts ultrasound energy into the bottom surface of the vessel. The ultrasound energy is then transferred into the liquid contained in the vessel. By recovering energy reflected from the liquid surface, this type of transducer can provide the information needed to determine the liquid level. This approach has not gained widespread use due to a number of limitations. Among these are the requirement that the bottom surface of the vessel be accessible, and of reasonably flat shape. Another requirement is that the vessel be made of metal. Many acid storage vessels are constructed of polymeric materials. These factors do not affect air-ranging transducers.

Air-ranging ultrasonic transducers are typically mounted over openings on top of, or inside the tops of, storage vessels in such a way that their radiating surfaces direct the acoustic sound waves down toward the material surface. Many industrial chemicals, including solvents and acids, give off vapors that condense on the air-ranging transducers subjecting them to chemical degradation.

Various materials have been employed for the construction of the outer components of ultrasonic transducers, primarily the enclosure and the radiating surface, in attempts to make them as chemically resistant as possible. Enclosures made from stainless steel or polymeric materials are typical, as are radiating surfaces made from fluoroplastics such as Polytetrafluoroethylene (PTFE). All of these materials are nevertheless subject to deterioration under prolonged exposure to some chemicals. The polymeric material covering the radiating surface of transducers is typically in the form of a relatively thin membrane. The membrane should be thin in order to preserve the transducer efficiency, enabling the transducer to transfer the maximum amount of acoustic energy into the gaseous medium in which the units operate. The porous nature of the membrane will, in time, allow some chemicals to permeate them, degrading the internal transducer components. These factors limit the applications to which existing air-ranging ultrasonic transducers can be subjected for prolonged periods of use.

SUMMARY OF THE INVENTION

It is an object of the invention to provide an air-ranging ultrasonic transducer specifically designed to operate in several chemical environments for prolonged periods of time without suffering physical degradation.

It is another object of the invention to provide an air-ranging ultrasonic transducer specifically designed to operate in severe chemical environments for prolonged periods of time without suffering performance degradation.

It is another object of the invention to provide an air-ranging ultrasonic transducer specifically designed to operate in severe chemical environments encompassing a range of materials not attainable by existing ultrasonic transducers.

These and other objects of the invention are provided by an ultrasonic transducer incorporating piezoelectric elements as the driving source to produce the vibrating signal which is subsequently converted into acoustic energy. The signal is further developed by a mechanism consisting of low-loss acoustic propagation material which provides an impedance match between the driving element and the gaseous medium which generally will be, but is not limited to, air, into which the acoustic signal is transmitted. A membrane, preferably of a polymeric material such as polytetrafluoroethylene, or other polymeric material, or stainless steel, is adhered to the acoustic propagation material and provides a solid signal-radiating surface for the transducer.

The transducer is enclosed in a cylindrical housing, preferably manufactured from a polymeric material such as Polyvinyl Chloride (PVC), or other polymeric material, or stainless steel. The end opposite to the signal-emitting end is preferably reduced in diameter and incorporates an external pipe thread onto which a coupling is installed. This coupling is preferably manufactured from a fluoroplastic material, such as polytetrafluoroethylene, or other polymeric material, and provides the means for attachment of the transducer to the vessel structure. The signal-carrying cable exits the transducer through this coupling.

The transducer enclosure, including the signal-emitting surface, is coated with Polyparaxylylene® (DPXN), a series of materials known by the generic name Parylene™. This is a linear, highly crystalline material which possesses superior barrier properties. The material is deposited on the transducer by means of free molecular dispersion in a vacuum environment. This process results in a closely controlled, pinhole-free coating, giving the transducer the ability to withstand exposure to a broader range of industrial chemicals than other materials available for this purpose.

DETAILED DESCRIPTION OF THE INVENTION

Figure 1:
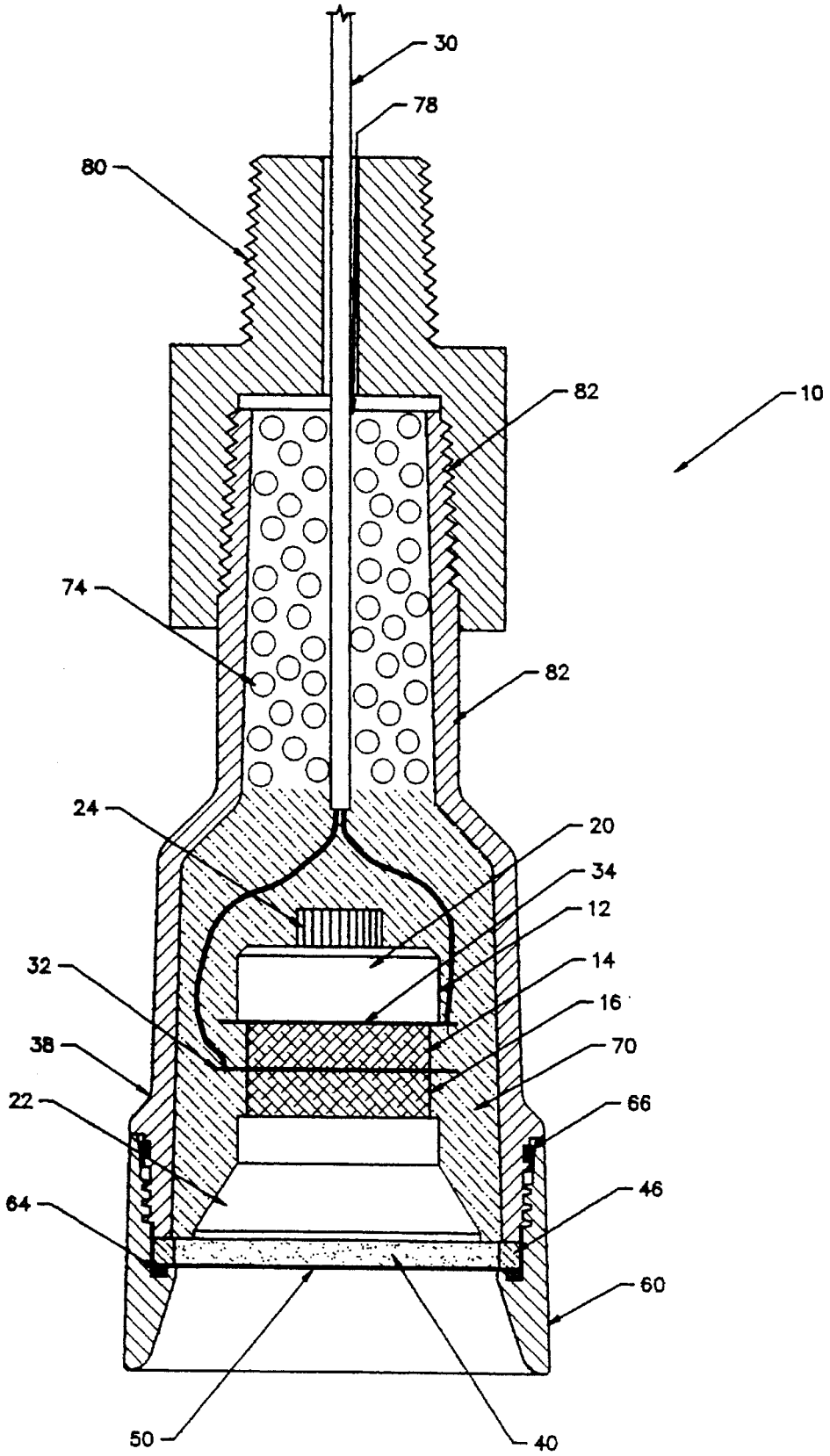
FIG. 1 is an axial cross-sectional view of a preferred embodiment of the inventive transducer.

The transducer 10 includes a resonant driving assembly 12 comprised of two piezoelectric discs 14, 16 placed between two metallic masses 20, 22 and held in a compressive mode by a threaded bolt 24 which is screwed into the forward metallic mass 22. The physical dimensions of these masses 20, 22 establish the resonant operating frequency of the assembly 12. The electrical excitation signal is introduced into the piezoelectric discs 14, 16 via a coaxial cable 30 attached to conductive shims 32, 34. The above-described resonant driving assembly 12 is housed in a generally cylindrical enclosure 38. A propagation disc 40 of low-loss acoustic propagation material is bonded to the forward mass 22. The thickness of the propagation disc 40 is precisely chosen to provide the correct impedance match between the lower piezoelectric disc 16 and the gaseous medium in which the transducer 10 is designed to operate. A rigid ring 46 surrounds the disc 40 and serves to locate the assembly 12 within the enclosure 38. A membrane or coating 50 is bonded to the propagation disc 40 within the ring 46 and serves as a solid surface onto which a chemical-resistant coating is deposited. The coating is preferably either a film of polymeric material having a thickness of between 0.001" and 0.01" or stainless steel foil having a thickness of between 0.001" and 0.005".

The cylindrical enclosure 38 incorporates threads onto which a bezel 60 is screwed to capture propagation disc 40, ring 46, and driving element assembly 12 within the enclosure 38. Elastomeric O-ring seals 64, 66 are compressed in slots between the enclosure 38 and bezel 60 to allow for manufacturing tolerances and provide sealing against entry of surface-preparation liquids prior to the final coating process. The cavity inside the enclosure 38 is filled with a flexible encapsulating material 70 to provide additional sealing and electrical insulation for the driving element assembly 12. The material 70 retains its flexible characteristics after curing, which allows the assembly 12 to physically oscillate at its operating frequency. A reduced diameter portion of the enclosure 38 is filled with a rigid encapsulating 74 containing lead pellets which provide a dampening mass to reduce transmission of vibrations from the transducer 10 to the mounting structure on the vessel (not shown). The encapsulant 74 serves to seal an opening 78 of the enclosure 38 through which the cable 30 passes.

A uniform coating of Polyparaxylylene® is deposited on all external surfaces of the transducer 10. The preferred thickness of this coating is between 0.0001" and 0.001". Polyparaxylylene is a proprietary product available from Union Carbide Corporation. A threaded coupling of fluoroplastic material 80 is screwed onto a threaded rear boss 82 of the enclosure 38 to provide for mounting into a threaded mounting structure (not shown) without damaging the coating on the threads of the transducer enclosure.

We claim:

1. A chemically insensitive ultrasound transducer for measuring the level of industrial chemicals, said transducer system comprising:

a piezoelectric driving assembly having an acoustic radiating surface;

a low-loss acoustic propagation disc covering and being acoustically coupled to the radiating surface of said piezoelectric driving assembly;

an enclosure surrounding said piezoelectric driving assembly and propagation disc; and a coating of polyparaxylylene having a thickness of between 0.0001 inch and 0.001 inch covering all externally exposed surfaces of said piezoelectric driving assembly, propagation disc, and enclosure to make said transducer system substantially impervious to said industrial chemicals.

2. The transducer of claim 1, further including a coupling of fluoroplastic material attached to an end of said enclosure opposite the radiating surface of said piezoelectric driving assembly.

3. The transducer of claim 1, further including a disc coating of a material suitable for said polyparaxylylene coating to bond covering an externally exposed surface of said acoustic propagation disc.

4. The transducer of claim 3 wherein said disc coating is a polymeric material having a thickness of between 0.001 inch and 0.01 inch.

5. The transducer of claim 3 wherein said disc coating is a foil of stainless steel having a thickness of between 0.001 inch and 0.005 inch.

6. The transducer of claim 1 wherein said cylindrical enclosure is fabricated from a polymeric material.

7. The transducer of claim 1 wherein said cylindrical enclosure is fabricated from stainless steel.

8. A method of making an ultrasound transducer substantially impervious to industrial chemical degradation, said method comprising coating all externally exposed surfaces of said transducer with a coating of polyparaxylylene having a thickness of between 0.0001 inch and 0.001 inch.

9. The method of claim 8 wherein said ultrasound transducer has an acoustic radiating surface, and wherein said method further includes the step of coating said acoustic radiating surface with a material to which said polyparaxylylene can readily bond prior to coating said transducer with said polyparaxylylene.

10. The method of claim 9 wherein said material is a foil of stainless steel having a thickness of between 0.001 inch and 0.05 inch.

11. The method of claim 9 wherein said material is a layer of polymeric material having a thickness of between 0.001 inch and 0.01 inch.

* * * * *